US005938494A

United States Patent [19]

Betsui et al.

[11] Patent Number: 5,938,494

[45] Date of Patent: Aug. 17, 1999

[54] METHOD FOR PRODUCING A PLASMA DISPLAY PANEL

[75] Inventors: Keiichi Betsui; Souichirou Hidaka, both of Kawasaki, Japan

[73] Assignee: Fujitsu Limited, Kawasaki, Japan

[21] Appl. No.: 08/828,294

[22] Filed: Mar. 21, 1997

[30] Foreign Application Priority Data

Nov. 20, 1996 [JP] Japan ..... 8-309589

[51] Int. Cl.[6] ..... H01J 9/00

[52] U.S. Cl. ..... 445/24; 445/58

[58] Field of Search ..... 445/24, 58

[56] References Cited

U.S. PATENT DOCUMENTS

| | | | |
|---|---|---|---|
| 3,827,776 | 8/1974 | Nakayama et al. | 445/24 |
| 3,918,136 | 11/1975 | Ernsthausen | 445/58 |

FOREIGN PATENT DOCUMENTS

| | | | |
|---|---|---|---|
| 2 332 609 | 11/1976 | France . | |
| 62-237635 | 10/1987 | Japan | 445/58 |
| 5-234519 | 9/1993 | Japan . | |

OTHER PUBLICATIONS

Patent Abstract of Japan, vol. 5, No. 125, JP 56–061739, Oct. 23, 1979.

Patent Abstracts of Japan, vol. 5, No. 125, JP 56–061740, Oct. 23, 1979.

Patent Abstracts of Japan, vol. 13, No. 150, JP 63–310539, Jun. 12, 1987.

Patent Abstracts of Japan, vol. 5, No. 15, JP 55–147345, Apr. 24, 1979.

*Primary Examiner*—Kenneth J. Ramsey
*Assistant Examiner*—Gene H. Rhodes
*Attorney, Agent, or Firm*—Staas & Halsey

[57] ABSTRACT

A method for producing a plasma display panel, including the steps of forming electrodes on at least one of a pair of substrates, covering the electrodes with a dielectric film, forming a protective film on the dielectric film for protecting the dielectric film from electric discharge, forming a temporary protective film on the protective film for temporarily protecting the protective film until the panel is assembled, assembling the panel from the pair of substrates, and subsequently removing the temporary protective film by generating plasma in the panel.

10 Claims, 5 Drawing Sheets

METHOD FOR PRODUCING A PLASMA DISPLAY PANEL

BACKGROUND OF THE INVENTION

1. Field of the Invention

The present invention relates to a method for producing a plasma display panel (PDP).

2. Description of Related Art

PDPs are usually flat and have advantage in placement and power consumption over cathode-ray tube (CRT) displays. The general structure of PDPs will be explained taking for example an AC-driven PDP of a surface discharge type having three kinds of electrodes with reference to FIG. 5.

Referring to FIG. 5, a PDP 1 has such a structure that a glass substrate on the front side (front substrate) 11 is put together with a glass substrate on the rear side (rear substrate) 21 in an opposing relation. On the inside surface of the front substrate, a pair of sustain electrodes X and Y are disposed on each line L of a matrix for display. The sustain electrodes X and Y each include a transparent electrode 41 and a bus electrode 42. The sustain electrodes X and Y are covered with a dielectric layer 17 for AC-driving. On the surface of the dielectric layer 17, a protective film 18 is formed.

On the inside surface of the rear substrate, on the other hand, address electrodes A are disposed in stripes on a base layer 22. On the address electrodes, an insulating layer 24 is formed. On the insulating layer 24, barrier ribs 29 are formed to partition the address electrodes separately. In grooves between the barrier ribs, red, green and blue fluorescent layers 28R, 28G and 28B for color display are provided so as to cover the address electrode A. The barrier ribs 29 partition a discharge space 30 into sub-pixels in the direction of the line L and define the height of the discharge space 30 at a certain value, for example, 150 $\mu$m. The discharge space 30 is filled with a gas for electric discharge for display. One pixel consists of three of the sub-pixels adjacent in the direction of the line.

For conducting display with this AC-driven PDP, a pixel is addressed for the display by electric discharge between one of the address electrodes and one of the sustain electrodes (e.g., Y electrode), and then, for maintaining the display, AC voltage is applied between the sustain electrodes X and Y to generate surface electric discharge for producing plasma for display via the dielectric 17.

The protective film 18 is provided to lower the firing potential at such electric discharge. Usually usable as the protective film 18 is MgO, which is a secondary-emission material which has high secondary emission efficiency and is hardly sputtered by the discharge gas for display.

CaO and SrO are also known as other materials having such secondary-emission characteristics.

However, most materials suitable for the protective film 18 easily react (having high deliquescence) with moisture or carbon oxides such as carbon dioxide in the air. Accordingly, when such materials are left in the air after they are formed into a film, the surface of the film is denaturalized. Therefore, when MgO is used as the protective film, for example, it is necessary to decompose the denaturalized layer formed on the surface of MgO by heating the panel to about 350° C. at discharging impure gas inside the panel, after the assembly of the front substrate 11 and the rear substrate 21 into the panel with the discharge space 30 in between and with the periphery of the substrates sealed, and then to introduce the discharge gas for display.

In addition to MgO, CaO and SrO can also be used as the protective film. However, when CaO and SrO are used, higher temperatures than in the case of MgO are required for decoposing the denaturalized layer from the surface of the protective film. Therefore the protective film of these materials are not put into practice.

The formation of the protective film with MgO is known, for example, by Japanese Unexamined Patent Publication No. Hei 5(1993)-234519. In this reference, the protective film is formed as a <111> oriented film of MgO by vacuum evaporation in an atmosphere of oxygen or by ion assist vapor deposition using ion-beam irradiation.

SUMMARY OF THE INVENTION

Considering the above circumstances, the present invention is to provide a method for producing a plasma display panel, including the step of covering the protective film with a temporary protective film during production, which is removed after the panel is assembled. Thereby the denaturalized layer is prevented from forming in the surface of the protective film. And it is not necessary any more to decompose the denaturalized layer in the surface of the protective film. Accordingly, usable is a sealing medium having lower heat resistance than conventionally used sealing media. Also CaO and SrO can be employed as the protective film.

The present invention provides a method for producing a plasma display panel comprising the steps of: forming electrodes on at least one of a pair of substrates; covering the electrodes with a dielectric film; forming a protective film on the dielectric film for protecting the dielectric film from electric discharge; forming a temporary protective film on the protective film for temporarily protecting the protective film until the panel is assembled; assembling the panel from the pair of substrates; and subsequently removing the temporary protective film by generating plasma in the panel.

According to the present invention, since the formation of the temporary protective film immediately follows the formation of the protective film in an atmosphere of oxygen, the protective film is never exposed to the air. Therefore, no denaturalized layer is formed in the surface of the protective film because the protective film does not react with moisture or carbon oxides in the air.

Also the temporary protective film is removed by generating plasma inside the panel after the assembly of the panel from the pair of substrates. Thus it is unnecessary to decompose with heat a denaturalized layer of the protective film, and it is possible to set the temperature at discharging the impure gas inside the assembled panel lower than in the conventional methods. Therefore a sealing medium having a lower heat resistance than conventional sealing media can be used. Also, CaO, SrO and the like, incapable of being used in the conventional methods, have become able to be used as the protective film.

DESCRIPTION OF THE PREFERRED EMBODIMENTS

Figure 1A:
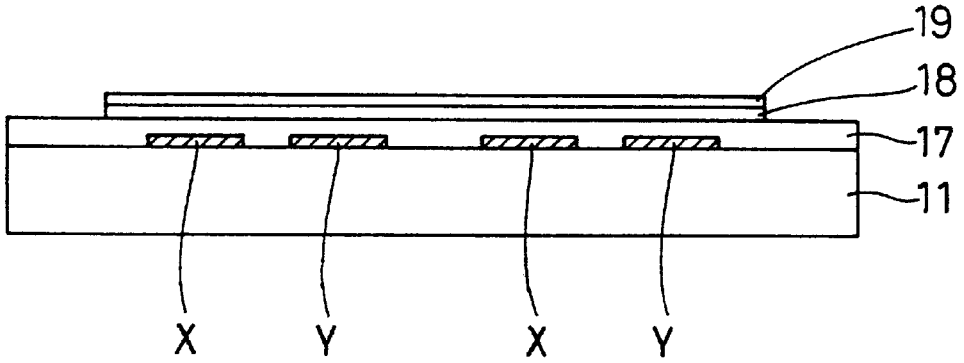
FIGS. 1A and 1B illustrate the outline of a method for producing a PDP in accordance with Example 1 of the present invention.

In the present invention, the pair of substrates may be composed of a front substrate and a rear substrate. These substrates may be made of glass.

The electrodes formed on at least one of the pair of substrates may be made of ITO (Indium thin Oxide) or NESA film transparent electrodes, and of a metal having a low electric resistance such as silver, three-layer metal of chrome-copper-chrome (Cr—Cu—Cr) and aluminum for metal electrodes.

The dielectric film may be made of a low-melting glass.

As the protective film, usable is any secondary-emittig material that has large secondary-emission efficiency and is not liable to be sputtered by the gas for electric discharge for display. Examples of the material having such characteristics are MgO, CaO, SrO, BaO, and compounds thereof. This protective film may be formed by PVD (Physical vapor deposition) or by sputtering.

As the temporary protective film, usable is any material that has low water permeability. This low water permeability means that the protective film under the temporary protective film is prevented from reacting with moisture or carbon oxides in the air. Examples of the material having such characteristics are SiN, $SiO_2$, $Al_2O_3$, MgO, $TiO_2$, $MgF_2$, $CaF_2$ and compounds thereof.

As the sealing medium used for sealing the periphery of the substrates for assembling the panel, usable are low-melting glass and various kinds of organic materials.

The removal of the temporary protective film may be carried out by introducing a gas for electric discharge for removal into the discharge space between the pair of substrates, and then applying voltage to generate electric discharge between the electrodes to etch the temporary protective film.

More particularly, the temporary protective film can be removed by plasma etching by use of, for example, a gas containing fluorine such as $CF_4$ and $SF_6$ as the discharge gas for removal.

After the removal of the temporary protective film, the discharge gas for removal is taken out from the inside of the panel and then the discharge gas for display is introduced into the panel. This discharge gas for display is to be used when the panel is used as a finished product. Alternately, a getter may be provided in the panel, and the discharge gases for display and for removal are introduced together into the panel. After the removal of the temporary protective film by electric discharge, the getter is activated to remove the discharge gas for removal contained from the inside of the panel.

In another aspect, the present invention provides a substrate assembly for a plasma display panel comprising electrodes formed on the surface of the substrate, a dielectric layer covering the electrodes, a protective film for protecting the dielectric layer from electric discharge, a temporary protective film for protecting the protective film temporarily for a period of time up to the step of assembling the panel.

The present invention will hereinafter be described in detail with reference to examples illustrated in the attached figures. These examples, however, should not be construed to limit the scope of the invention.

EXAMPLE 1

Figure 1B:
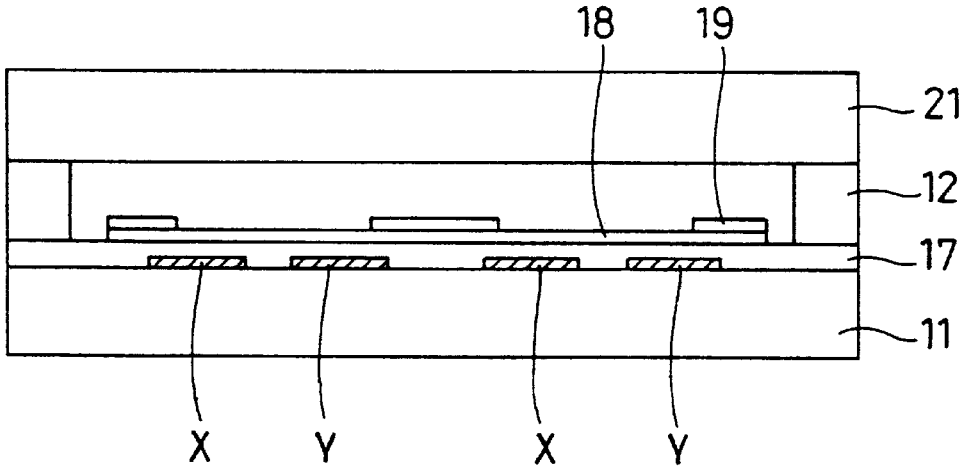
Figure 5:
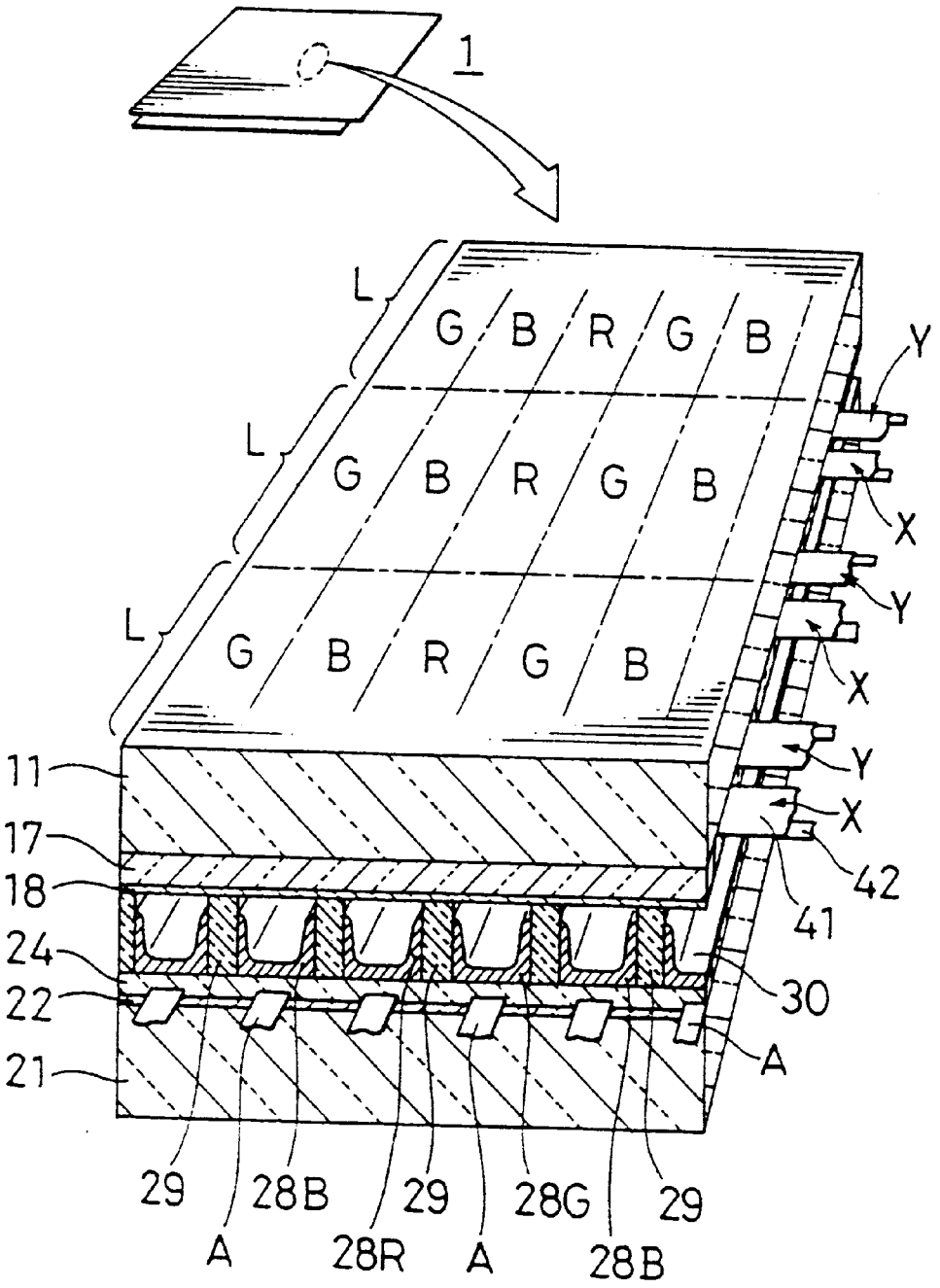
Fig. 5 (PRIOR ART)
FIG. 5 illustrates the structure of an AC-driven PDP of a surface discharge type.

FIGS. 1A and 1B are schematic views illustrating a method of producing a PDP in accordance with Example 1 of the present invention. This example is an example applied to the three-electrode surface-dischage-type PDP shown in FIG. 5. Address electrodes and barrier ribs on a rear substrate are omitted in FIGS. 1A and 1B.

As shown in FIGS. 1A and 1B, according to the method of producing the PDP of Example 1 of the present invention, a pair of sustain electrodes X and Y are formed for each line of a display matrix on the inside surface of a front substrate 11, the sustain electrodes X and Y are covered with a dielectric film 17 of low-melting glass, and, on the surface of the dielectric film 17, formed is a protective film 18 of MgO which has a good electric-discharge characteristic.

Subsequently, in a vacuum atmosphere (under reduced pressure) in which the protective film 18 has been formed, a temporary protective film (SiN film) 19 is continuously formed of SiN having low water permeability on the protective film 18 by vacuum vapor deposition. The temporary protective film 19 is formed by high-frequency sputtering in a vacuum chamber and the front substrate 11 is taken out of the vacuum chamber (see FIG. 1A).

Thus, when the front substrate 11 is taken out of the vacuum chamber and exposed to the air, the temporary protective film 19 covers the reactive protective film 18 and therefore the protective film 18 is insulated from moisture in the air.

The front substrate 11 and a rear substrate 21 are then assembled into the panel with the electrodes thereof facing each other and with the peripheral portions of the substrates sealed with a sealing medium 12. Then the temporary protective film 19 is removed only above the sustain electrodes X and Y (a region for surface discharge) (see FIG. 1B).

The temporary protective film 19 above the region for the surface electric discharge is unnecessary at the discharge for display when the panel is put in practical use as a PDP. Therefore, the temporary protective film 19 above this region is removed by applying voltage between the sustain electrodes X and Y to generate surface discharge when the gas between the substrates is removed after the assembly of the panel. This removal by electric discharge is called plasma ethcing.

FIGS. 2A to 2E illustrate the production method of Example 1 step by step, based on which the production method of Example 1 will be explained in detail.

Figure 2A:
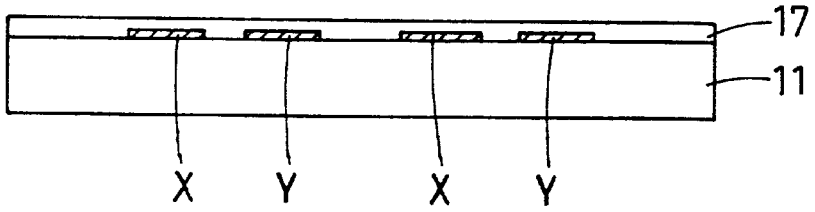
FIGS. 2A to 2E illustrate the production method in accordance with Example 1 step by step.

(a) Step of forming the electrodes and the dielectric film (see FIG. 2A)

A transparent conductive film is formed on the surface of the front substrate 11 of glass by sputtering and then made into transparent electrodes by photolithography. The transparent conductive film is made of ITO film or NESA film.

A metal conductive film is formed on the transparent electrodes by sputtering and then made into bus electrodes by photolithography. The metal conductive film is made of a metal having low electric resistance such as silver, three-layer metal of Cr—Cu—Cr, and aluminum. The sustain electrodes X and Y each consist of the transparent electrode and the bus electrode.

The sustain electrodes X and Y are then coated with the dielectric film 17. The dielectric film 17 is made of low-melting glass.

Figure 2B:
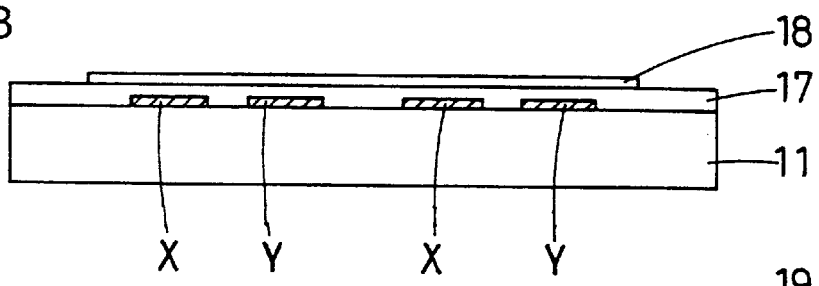

(b) Step of forming the protective film (see FIG. 2B)

In order to improve the discharge characteristic, the surface of the dielectric film 17 is covered with the protective film 18 of MgO, which is highly efficient in secondary emission and is unliable to be sputtered by the discharge gas for display. The formation of the protective film 18 is carried out in a vacuum chamber by vapor deposition.

Figure 2C:
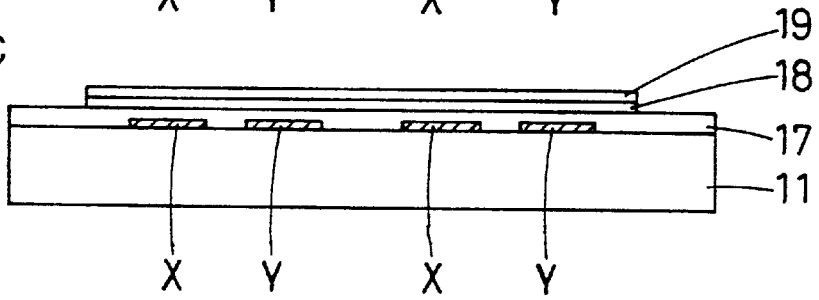

(c) Step of forming the temporary protective film (see FIG. 2C)

After the formation of the protective film 18, the SiN film 19 is sequentially formed on the protective film 18 by RF sputtering. The SiN film has low water permeability. Then, the glass substrate 11 is taken out of the vacuum chamber.

Figure 3:
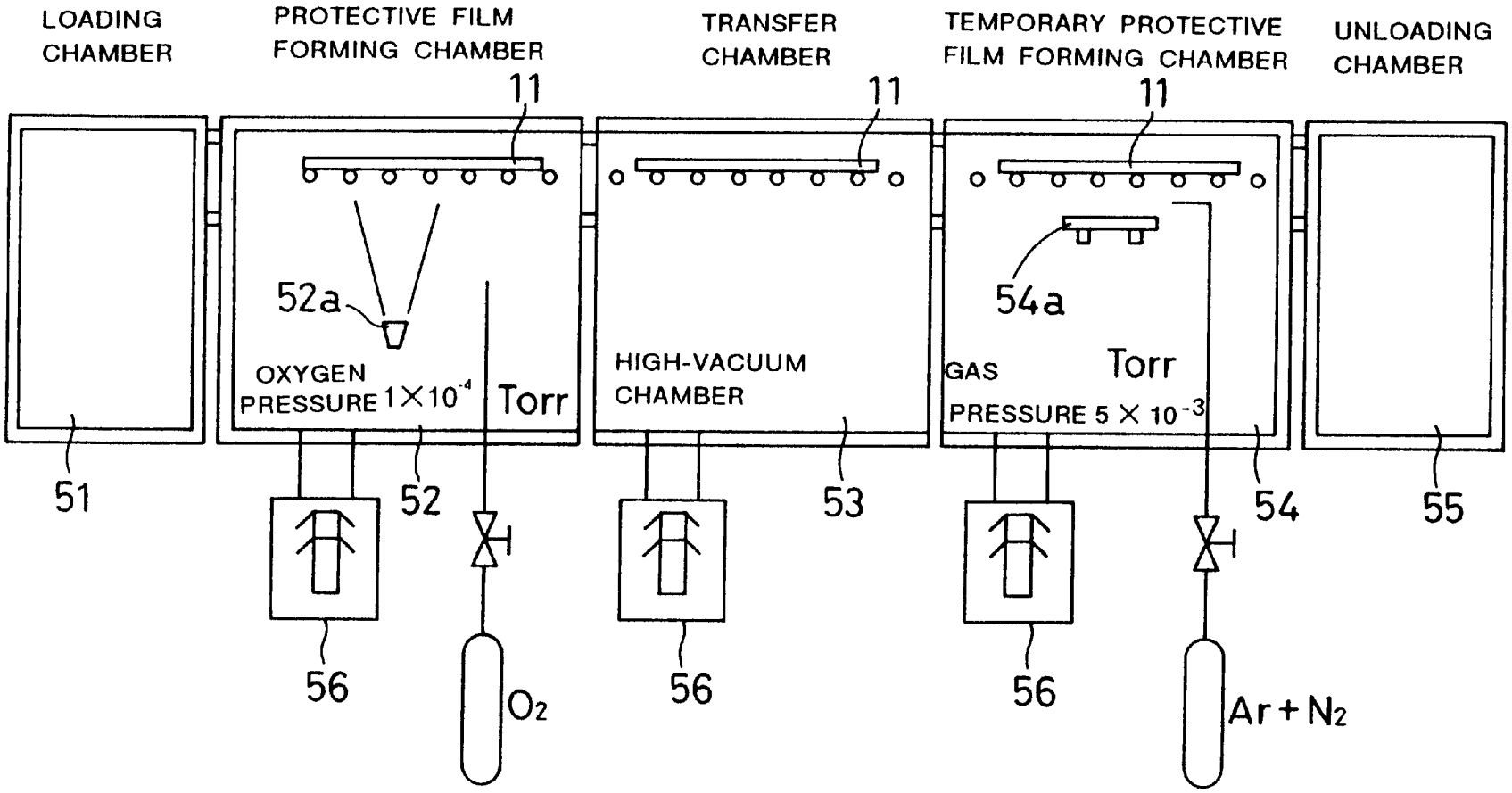
FIG. 3 illustrates the organization of an apparatus for forming a protective film and a temporary protective film.

FIG. 3 shows an apparatus for forming the protective film and the temporary protective film. Referring to FIG. 3, in order to form the protective film and the temporary protective film on the dielectric film, the front substrate 11, for which the steps up to the formation of the dielectric film 17 has been finished, is first put in a loading chamber 51 and then transferred into a protective film forming chamber 52. The pressure of oxygen inside the protective film forming chamber 52 is $1\times10^{-4}$ Torr.

When MgO is used for the protective film 18, for example, a MgO film is deposited onto the surface of the dielectric film 17 using a MgO source 52*a*. Continuously the front substrate 11 is transferred into a high-vacuum transfer chamber 53 and next transferred into a temporary protective film forming chamber 54. When SiN is used for the temporary protective film 19, for example, a SiN film is formed onto the surface of the protective film 18 using a SiN target 54*a*. The pressure of the gas inside the temporary protective film forming chamber 54 is $5\times10^{-3}$ Torr. Then the front substrate 11 is transferred into an unloading chamber 55 and taken out. All three of the different chambers mentioned above are connected to an appropriate vacuum source 56, that meet the functional needs of each chamber operation.

Then the sealing medium 12 of low-melting glass is applied to the periphery of the front substrate 11 to form a sealing portion.

Figure 2D:
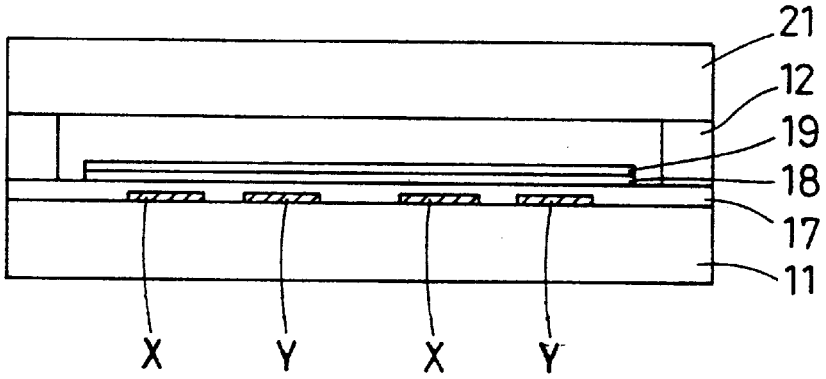

(d) Step of assembling the panel (see FIG. 2D)

A electrically conductive metal film is formed on the surface of the rear substrate 21 of glass by sputtering and then made into address electrodes by photolithography. The metal conductive film is made of a metal having low electric resistance such as silver, three-layer metal of Cr—Cu—Cr and aluminum.

The address electrodes is coated with an insulating layer. The insulating layer is made of low-melting glass.

A layer of a material for barrier ribs is formed on the entire surface of the insulating layer and then made into barrier ribs by sandblasting. The barrier ribs are made of low-melting glass. Then a fluorescent paste is applied between the barrier ribs to form a fluorescent layer by screen printing.

The rear substrate 21 and the front substrate 11 thus formed are put together so that the address electrodes and the sustain electrodes crossingly face each other. With this state maintained, the substrates are heated so that the sealing medium 12 melts to stick the front substrate 11 to the rear substrate 21 together, thus the panel being assembled. At the same time, a exhaust tube (not shown) for discharging the inside gas is fitted.

The gas inside the panel is discharged through the exhaust tube.

Figure 2E:
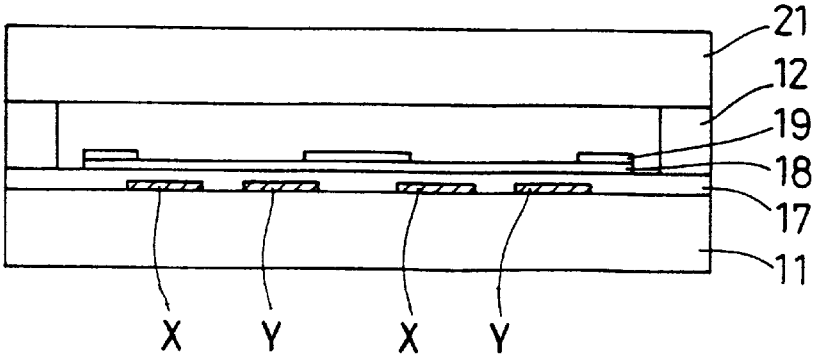

(e) Step of removing the temporary protective film (see FIG. 2E)

The electric gas for removal is introduced into the panel. AC voltage is applied between the sustain electrodes X and Y to generate plasma (surface electric discharge) between both the sustain electrodes, so that the SiN film 19 is removed from the surface above the sustain electrodes X and Y by etching with the generated plasma. Here, the SiN film 19 is removed only from the regions above the sustain electrodes X and Y (the region for surface electric discharge for display).

As the discharge gas for removal, used is a fluorine-base gas such as $CF_4$ and $SF_6$. However, when the temporary protective film 19 is made of SiN, an inert gas may also be used because SiN is rapidly (easily) sputtered.

The gas inside the panel is taken out, a discharge gas for display containing Ne and Xe is fed and the tip tube is sealed.

The PDP thus obtained has a good discharge characteristic because the protective film 18, which is easily affected by exposure to the air, does not contact the air.

EXAMPLE 2

In this example, the protective film 18 is made of $CaSrO_2$ which has a good secondary-emitting characteristic and the temporary protective film 19 is made of MgO. The other materials are the same as used in Example 1. The formation of the protective film 18 and the temporary protective film 19 as well as the removal of the temporary protective film 19 is carried out in the same manner as described in Example 1.

The $CaSrO_2$ film is highly efficient in secondary emission and therefore requires an very low firing potential characteristically. However, the $CaSrO_2$ film is extremely unstable in the air. Consequently, when the $CaSrO_2$ film is left in the air, the $CaSrO_2$ film reacts with moisture or carbonic acid gas in the air to produce a denaturalized layer on the surface thereof. Because this denaturalized layer decomposes only at very high temperatures, $CaSrO_2$ cannot be used for the protective film for PDP conventionally.

In this example, however, since the formation of the $CaSrO_2$ film by vacuum vapor deposition is followed by the formation of the MgO film covering the $CaSrO_2$ film in a vacuum atmosphere, the $CaSrO_2$ film does not contact the air. Therefore even such a material unstable in the air as the $CaSrO_2$ film can be used as the protective film.

In this example, the $CaSrO_2$ film and the MgO film are continuously formed on the dielectric film by vacuum vapor deposition, and the MgO film is utilized as the temporary protective film. In this case, because the MgO film has a good discharge characteristic, the temporary protective film can be removed at relatively low voltage.

EXAMPLE 3

This example differs from Examples 1 and 2 only in the step of removing the temporary protective film 19. The steps are the same as described in Example 1 and 2 up to the assembling of the panel by putting together the front and rear substrates with the electrodes of both the substrates in the opposing relation and sealing the periphery of the substrates.

In Example 1 and 2, the temporary protective film is removed using the discharge gas for removal and then this discharge gas for removal is displaced by the discharge gas for display.

In this example, the discharge gases are not replaced. Instead a discharge gas is introduced at once, which contains discharge gas components for removal and for display. The panel is provided with a getter therein which acts to remove the discharge gas component for removal in the discharge gas after the removal of the temporary protective film 19 by plasma etching.

Figure 4A:
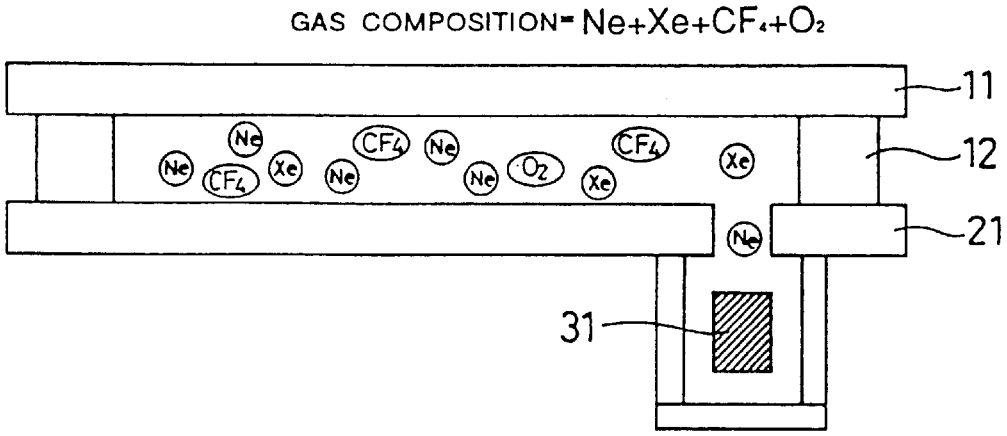
FIGS. 4A to 4C illustrate a production method in accordance with Example 3.
Figure 4B:
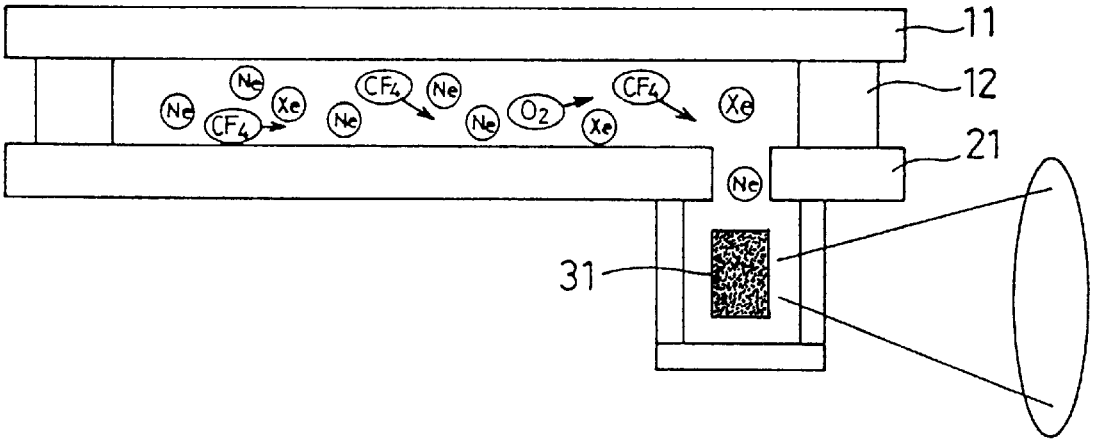
Figure 4C:
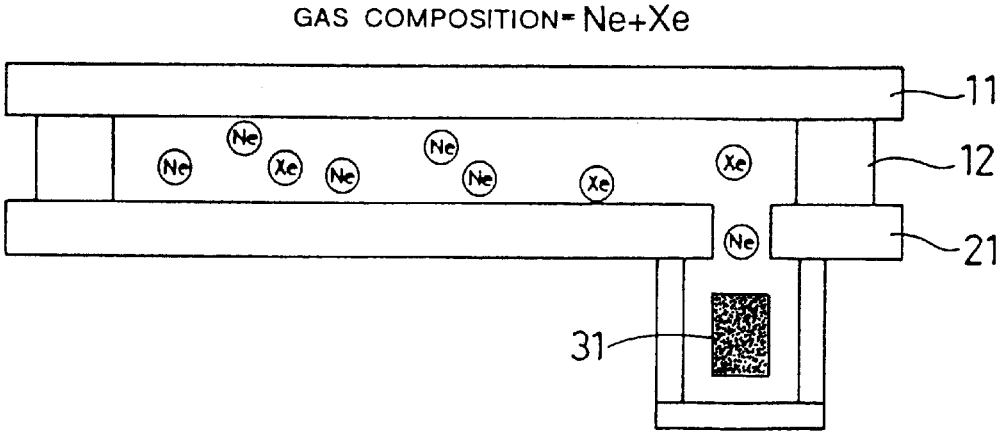

FIGS. 4A to 4C illustrate the production method of Example 3. Referring to FIGS. 4A to 4C, Example 3 will be further explained in detail.

In this example, a getter 31 is provided inside the panel composed of the front and rear substrates 11 and 21, for example, in the tip tube. When Ne+Xe is used as the discharge gas for display and $CF_4$ is used as the discharge gas for removal, for example, both the discharge gases are mixed together and introduced into the panel. Then the temporary film 19 is removed by plasma etching. At this time, the components of the discharge gas inside the panel are Ne, Xe, $CF_4$, and $O_2$ for the most part (see FIG. 4A).

Then, the getter 31 is activated by the emission of laser light and the like (see FIG. 4B).

Thus the components $CF_4$ and $O_2$ contained in the discharge gas are absorbed in the activated getter at the operation of the panel. Thereby the components of the discharge gas inside the panel come extremely close to Ne+Xe (see FIG. 4C).

In this case, the discharge gases for display and for removal may be introduced together into the panel or may be mixed beforehand and then introduced into the panel.

According to this example, it is possible to make the gas within the panel suitable for display without changing discharge gases in the panel.

All the above-described Example 1 to 3 are explained using as example the AC-driven three-electrode surface-discharge-type PDP in which the address electrode and the pair of the sustain electrodes are disposed separately on the two opposing substrates. However, the present invention may be applied to any AC-driven PDP such as a three-electrode surface-discharge-type PDP in which the three electrodes are disposed on one of the substrates, a two-electrode PDP of an opposed discharge type for general use in which two electrodes X and Y are disposed separately on two opposing substrates, and a two-electrode surface-discharge-type PDP wherein two electrodes X and Y are disposed on one of the substrates.

According to the present invention, after the forming of the protective film, the temporary protective film covering the protective film is continuously formed thereon. Therefore a denaturalized layer can be prevented from being produced in the surface of the protective film, so that the protective film for the PDP can have a good discharge characteristic. Besides, it is not required to decompose with heat a denaturalized layer in the surface of the protective film.

Further, after the assembly of the panel from one substrate and the other substrate, the temporary protective film is removed by generating plasma inside the panel. Therefore, since no step using heat is involved, it has become possible to use a sealing medium having lower heat resistance than the conventionally used media. It has also become possible to use, as the protective film, CaO, SrO and the like which have not been used conventionally.

What is claimed is:

1. A method for producing a plasma display panel comprising the steps of:

forming electrodes on at least one of a pair of substrates;

covering the electrodes with a dielectric film;

forming a protective film on the dielectric film for protecting the dielectric film from electric discharge;

forming a temporary protective film on the protective film for temporarily protecting the protective film until the panel is assembled;

assembling the panel from the pair of substrates; and subsequently removing the temporary protective film by generating plasma in the panel.

2. A method according to claim 1, wherein the protective film and the temporary protective film are continuously formed under a reduced pressure, thereby avoiding the formation of a denaturlized layer on the protective film.

3. A method according to claim 1, wherein the protective film is made of a material selected from the group consisting of MgO, CaO, SrO, BaO and a compound thereof.

4. A method according to claim 1, wherein the temporary protective film is a film of low water permeability.

5. A method according to claim 1, wherein the temporary protective film is made of a material selected from the group consisting of SiN, $SiO_2$, $Al_2O_3$, MgO, $TiO_2$, $MgF_2$, $CaF_2$ and a compound thereof.

6. A method according to claim 1, wherein the temporary protective film is removed by introducing a gas for electric discharge for removal into a discharge space of the panel and discharging electricity between the electrodes.

7. A method according to claim 6, wherein the gas for electric discharge for removal comprises a fluorine-containing gas such as $CF_4$ or $SF_6$.

8. A method according to claim 1, further comprising the steps of:

providing a getter in the panel;

introducing a gas for electric discharge for removal and a gas for electric discharge for display in a discharge space of the panel;

removing the temporary protective film by electric discharge between the electrodes;

activating the getter; and removing the gas for electric discharge for removal using the activated getter.

9. A method for producing a plasma display panel including electrodes insulated from a gas for electric discharge and a protective film which is made of a secondary emitting material and contacts the gas for electric discharge, comprising the steps of:

forming a temporary protective film on the protective film for temporarily protecting the protective film until the panel is assembled;

assembling the panel; and removing the temporary protective film by generating plasma in the panel.

10. A substrate assembly for a plasma display panel comprising:

electrodes on the substrate;

a dielectric layer covering the electrodes;

a protective film for protecting the dielectric layer from electric discharge; and a temporary protective film for protecting the protective film until the panel is assembled.

* * * * *